US005658059A

United States Patent [19]

Röck et al.

[11] Patent Number: 5,658,059

[45] Date of Patent: Aug. 19, 1997

[54] SUPPORT RAIL TO BE MOUNTED ON A SIDE OF A CABINET OF AN ARTICLE OF FURNITURE

[75] Inventors: Erich Röck, Höchst, Austria; Fredi Dubach, Adetswil, Switzerland

[73] Assignee: Julius Blum Gesellschaft m.b.H., Höchst, Austria

[21] Appl. No.: 372,371

[22] Filed: Jan. 13, 1995

[30] Foreign Application Priority Data

Jan. 17, 1994 [AT] Austria ..... 69/94

[51] Int. Cl.[6] ..... A47B 88/04

[52] U.S. Cl. ..... 312/334.6; 312/334.14; 312/334.32

[58] Field of Search ..... 312/334.1, 334.6, 312/334.12, 334.14, 334.15, 334.31, 334.33, 334.39, 334.27, 334.29, 334.32, 334.7, 334.8, 334.18, 334.34

[56] References Cited

U.S. PATENT DOCUMENTS

| | | | |
|---|---|---|---|
| 1,902,748 | 3/1933 | Ziehl | 312/334.33 |
| 2,056,407 | 10/1936 | Metcalf | 312/334.32 |
| 2,099,148 | 11/1937 | Tobey | 312/334.39 X |
| 2,212,191 | 8/1940 | Dietz | 312/334.18 |
| 3,131,009 | 4/1964 | Travis | 312/334.14 |
| 3,980,364 | 9/1976 | Entrikin et al. . | |
| 4,025,138 | 5/1977 | Kittle . | |
| 4,199,200 | 4/1980 | Livingston et al. . | |
| 4,438,994 | 3/1984 | Davis | 312/334.18 |
| 4,580,851 | 4/1986 | Nelson | 312/334.15 X |
| 4,627,760 | 12/1986 | Yagi et al. . | |
| 5,570,941 | 11/1996 | Rock et al. | 312/334.1 X |

FOREIGN PATENT DOCUMENTS

| | | | |
|---|---|---|---|
| 1554372 | 4/1970 | Germany | 312/334.12 |
| 28 44 850 | 4/1980 | Germany . | |
| 29 04 116 | 8/1980 | Germany . | |
| 33 35 700 | 4/1985 | Germany . | |
| 91 15 465.0 | 4/1992 | Germany . | |
| 660633 | 11/1951 | United Kingdom . | |

*Primary Examiner*—Peter M. Cuomo
*Assistant Examiner*—Janet M. Wilkens
*Attorney, Agent, or Firm*—Wenderoth, Lind & Ponack

[57] ABSTRACT

A pull-out guide assembly includes a support rail to be mounted on a piece of furniture and a pull-out rail to be mounted on a drawer. Rollers are provided for transmitting the load of the drawer from the pull-out rail to the support rail. The front end of the support rail is fastened to a frame of the piece of furniture. The rear end of the support rail extends without connection to a side wall of the piece of furniture into the piece of furniture. The rear end of the support rail is provided with a lateral strut which abuts the furniture side wall.

19 Claims, 11 Drawing Sheets

SUPPORT RAIL TO BE MOUNTED ON A SIDE OF A CABINET OF AN ARTICLE OF FURNITURE

BACKGROUND OF THE INVENTION

The invention relates to a support rail to be mounted on a side of a cabinet of an article of furniture and to cooperate with a pull-out rail mounted on a side of a drawer to form a guide assembly to guide movement of the drawer into and out of the cabinet, the support rail including a front end to be fastened to a frame of the cabinet and a rear end extending longitudinally from the front end and to extend rearwardly into the cabinet without connection thereto.

In most furniture cabinets, furniture fittings are mounted on the side wall. However, some cabinets have very thin side walls and feature a face frame on which all the furniture fittings are mounted. U.S. Pat. No. 3,980,364 and the U.S. Pat. No. 4,199,200 show roller bracket assemblies for drawers, whereby the support rail is fastened to a horizontal and a vertical member of the face frame and extends into the interior of the cabinet without being connected to a side wall of the cabinet.

SUMMARY OF THE INVENTION

The general object of the present invention is to provide a new and improved support rail for a drawer, whereby the unsupported rearward end portion of the support rail is prevented from shifting laterally when a drawer is pushed into or pulled out of the cabinet. Such lateral movement of the rear end of the support rail can loosen the fixing means by which the support rail is connected to the face frame.

The invention provides that the rear end of the support rail is provided with a strut projecting laterally therefrom to abut a side wall of the cabinet and thereby to provide lateral bracing of the support rail.

DETAILED DESCRIPTION OF PREFERRED EMBODIMENTS

Figure 1:
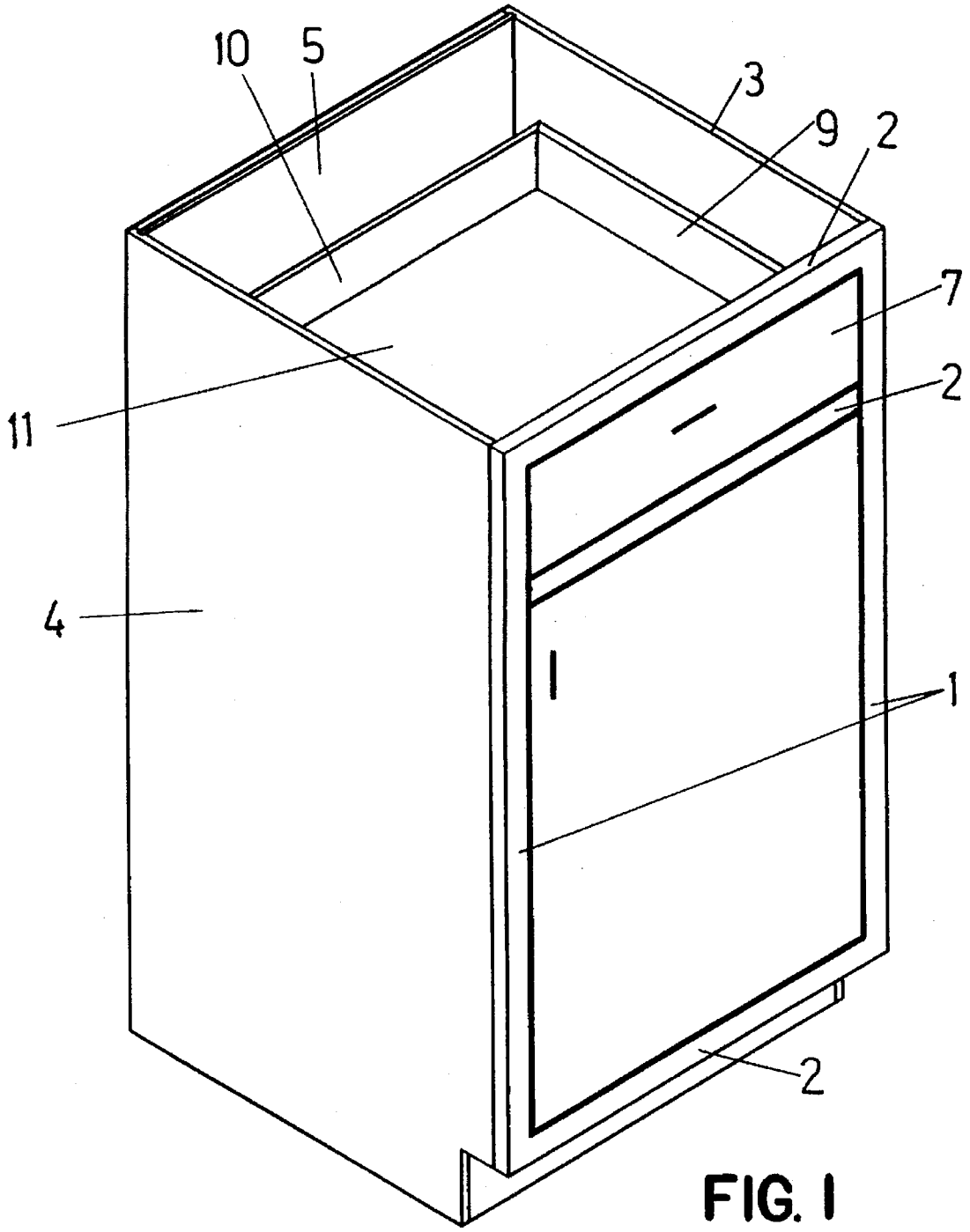
FIG. 1 is a perspective view of a cabinet with a top removed.
Figure 2:
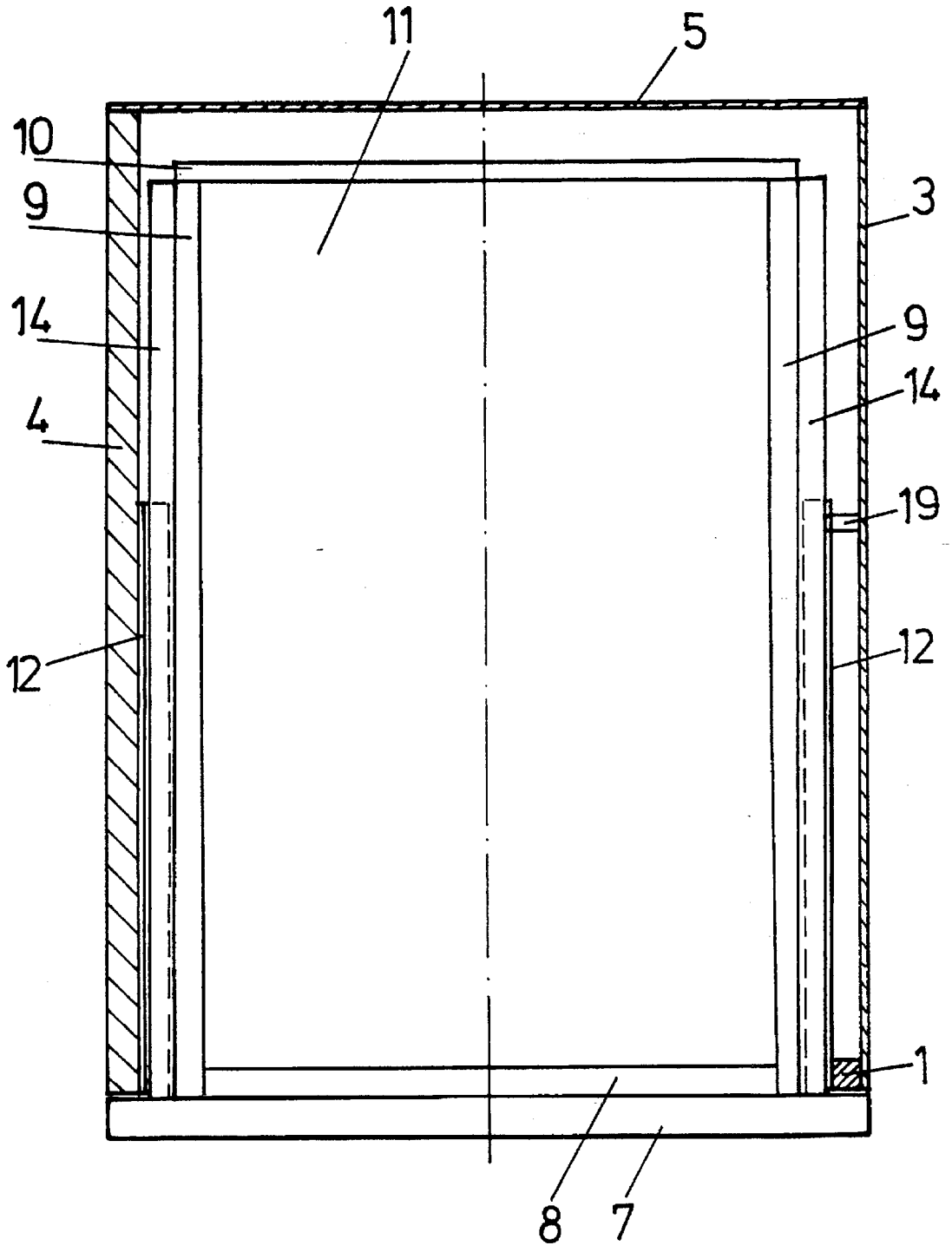
FIG. 2 is a horizontal section of the cabinet showing a drawer in plan view.
Figure 3:
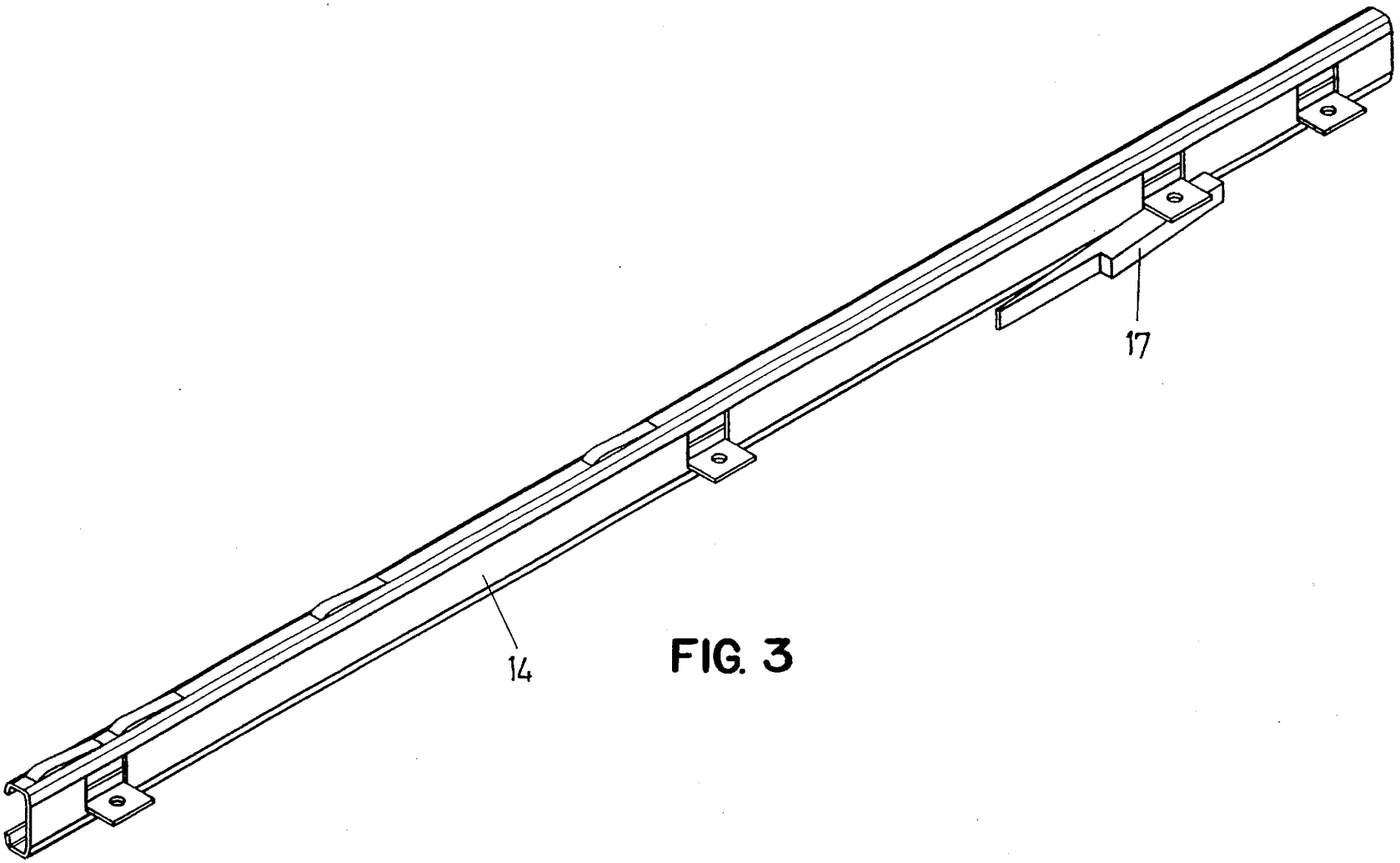
FIG. 3 is a perspective view of a pull-out rail, cooperating with a support rail according to the invention.
Figure 4:
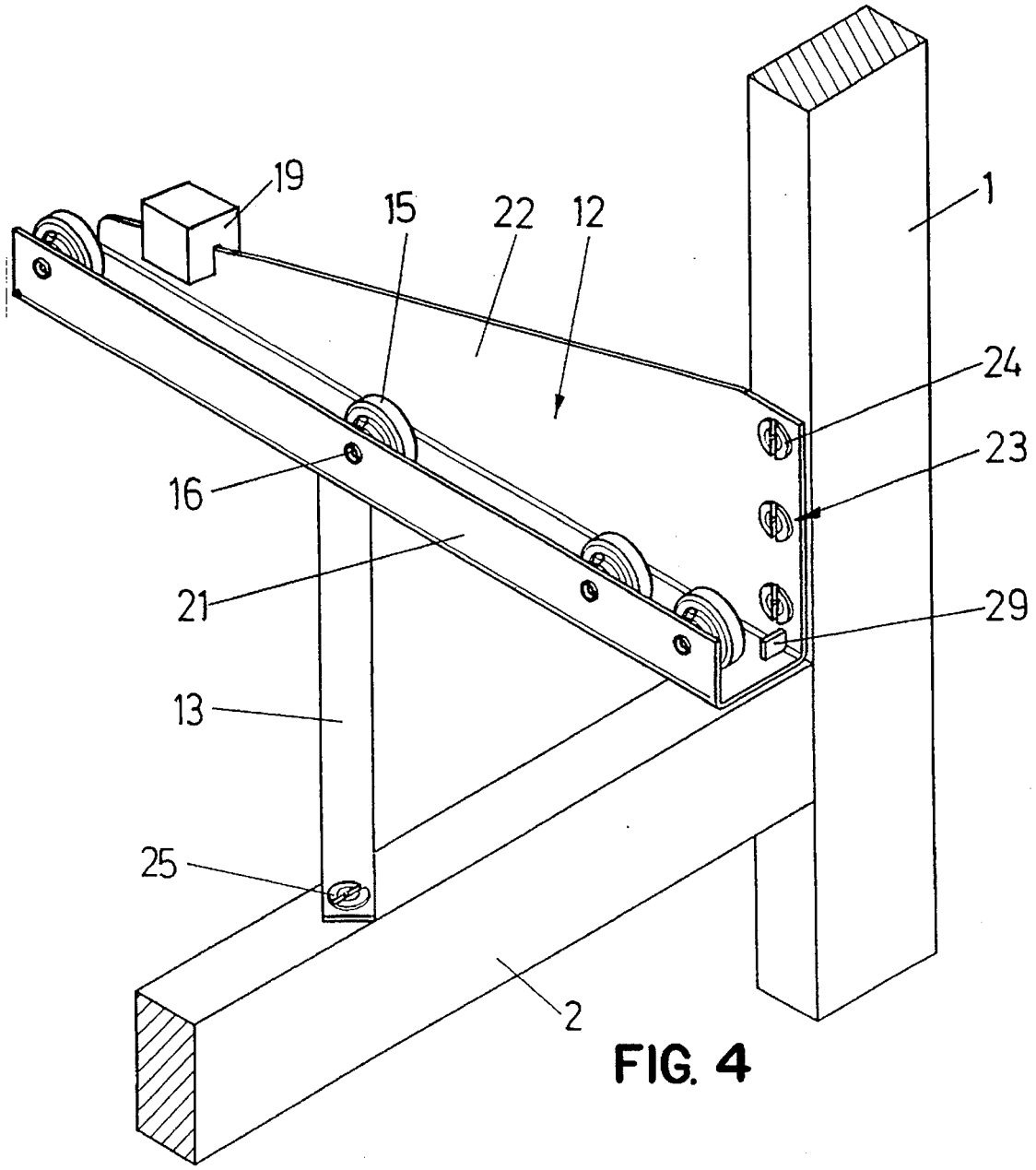
FIG. 4 is a perspective view of a support rail and a partial perspective view of a face frame.
Figure 5:
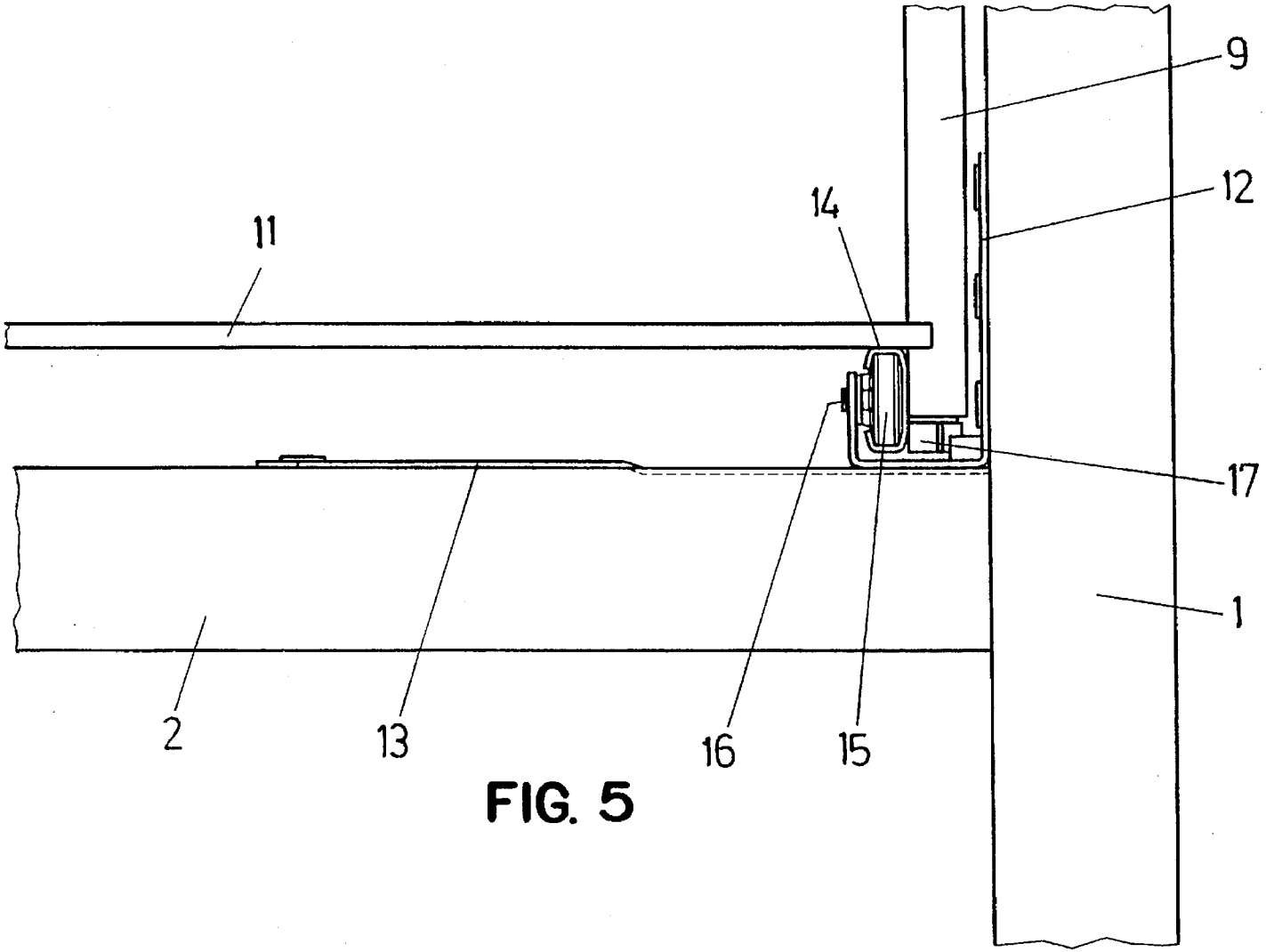
FIG. 5 is a plan view of a guide assembly and a fragmentary plan view of the drawer and the face frame.

A cabinet has side walls 3, 4 and a rear wall 5. Each side wall 3 is at the front covered by a vertical member 1 of a face frame. Above and beneath a drawer and at the bottom of the cabinet are horizontal members 2 of the face frame. The drawer includes two drawer side walls 9, a front plate 7, a front bracket 8, a drawer bottom 11 and a rear wall 10. A pull-out rail 14 is mounted on each side of the drawer by means of which the drawer is movable relative to respective support rails 12, which are fastened to the cabinet.

The support rail 12, which is fastened to the face frame, has a U-shaped section with a vertical flange 21 on which rollers are mounted by means of axles 16 and a vertical flange 22 which at its front end is provided with holes 23. The two vertical flanges 21 and 22 are spaced from each other and joined at the bottoms thereof by a horizontal flange. The support rail 12 is fixed to the vertical member 1 of the face frame by means of screws 24 protruding through the holes 23 in flange 22. The support rail 12 extends freely into the cabinet and is not fastened to the side wall 3 or rear wall 5. A bar 13 is fixed to the support rail 12 approximately in the middle thereof and is also fastened to the horizontal member 2 by means of a screw 25. The lateral strut is provided at the rear end of the support rail 12.

Figure 6:
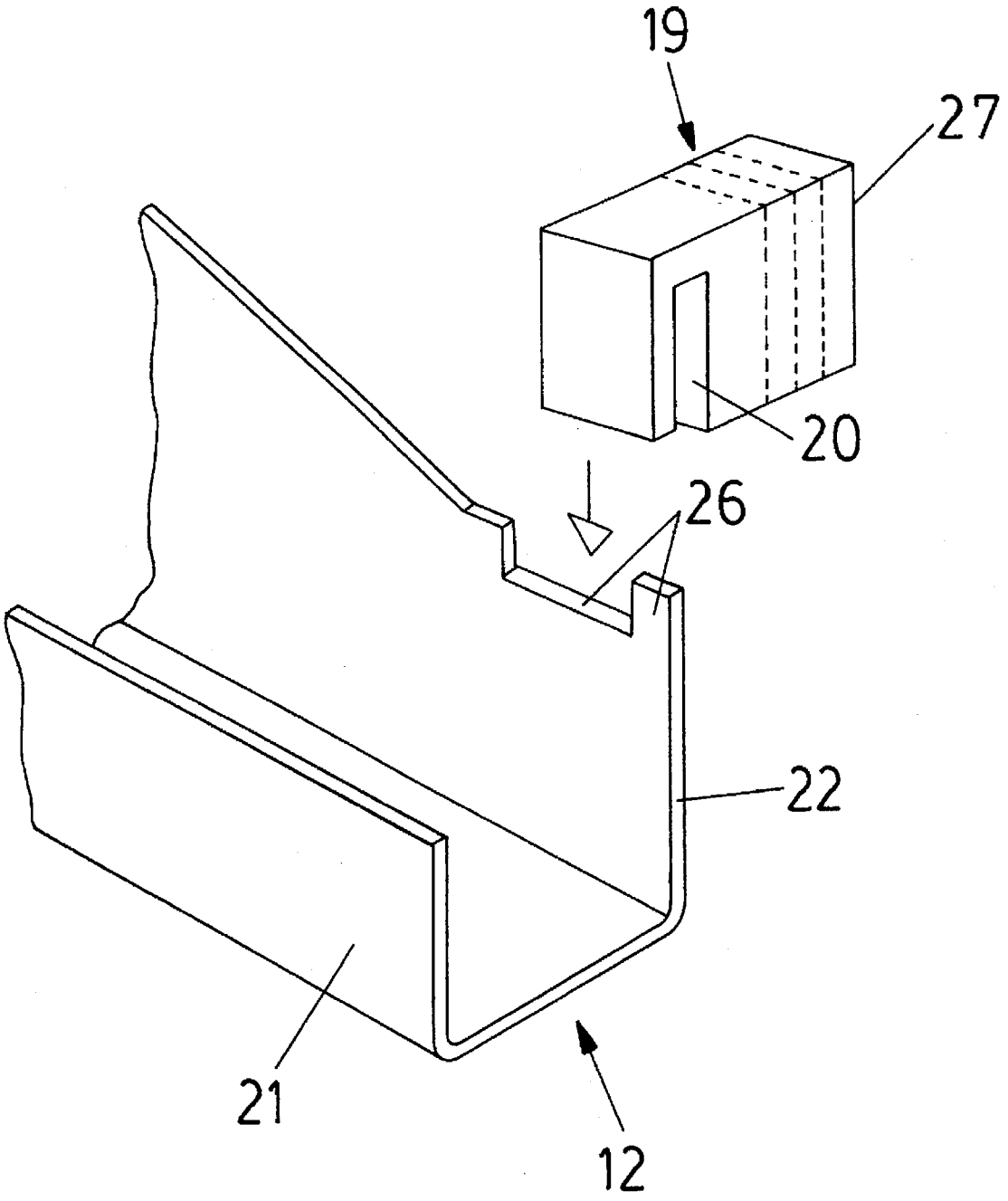
FIG. 6 is a fragmentary perspective view of a rear end of the support rail.

In the embodiment according to FIG. 6 the strut includes a block member 19 made of plastic material. The block member 19 has a slot 20, within which fits the outer vertical flange 22 of the support rail 12. The upper rim of outer vertical flange 22 is provided with a recess 26 in which the block member 19 is situated. The recess 26 prevents the block member 19 from sliding rearwardly and off the end of the support rail 12. At a face 27 abutting the furniture side wall 3, the block member 19 is advantageously provided with an adhesive layer providing a bond between the block member 19 and the furniture side wall 3.

Figure 7B:
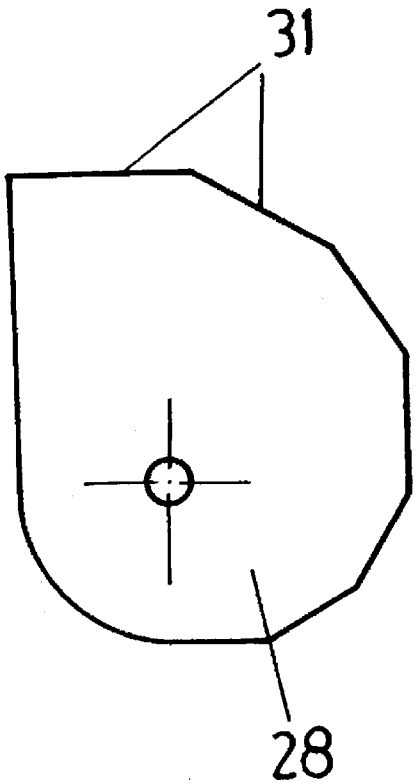
FIG. 7 to 11 are perspective views of rear ends of support rails according to further embodiments of the invention.
Figure 7A:
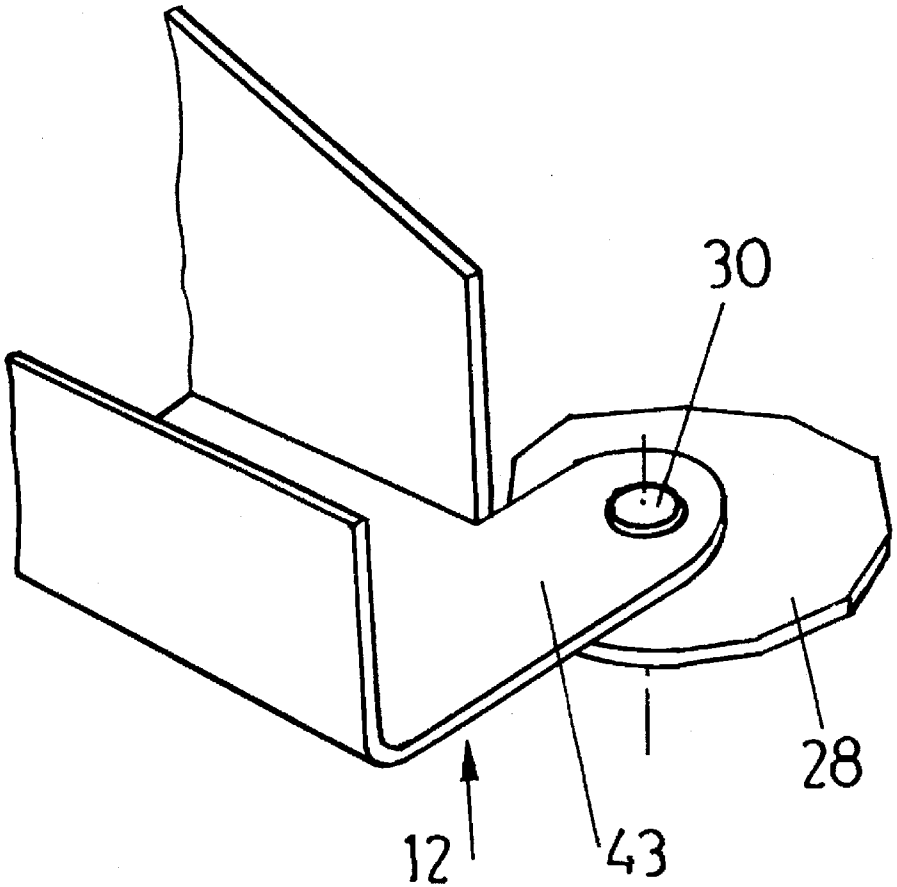

In the embodiment of FIG. 7 the strut includes an eccentric disc 28 which is rotatable about a vertical axis. The eccentric disc 28 has polygonal shape defined by plural edges 31 spaced from such axis by different distances. The eccentric disc 28 is mounted on a horizontal member e.g. a flap 43 of the support rail 12, by means of pin 30 defining the vertical axis.

Figure 8:
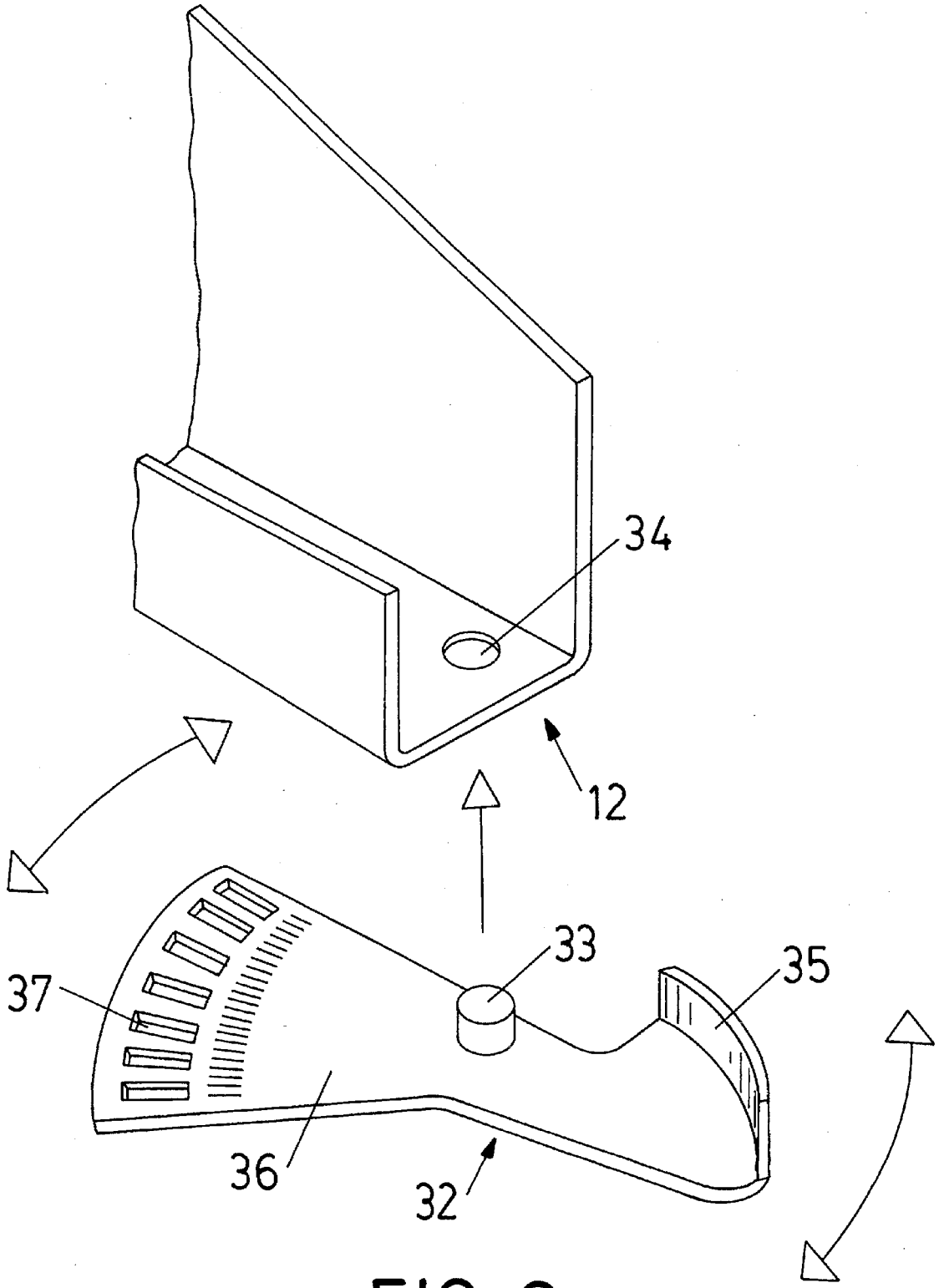
Figure 9:
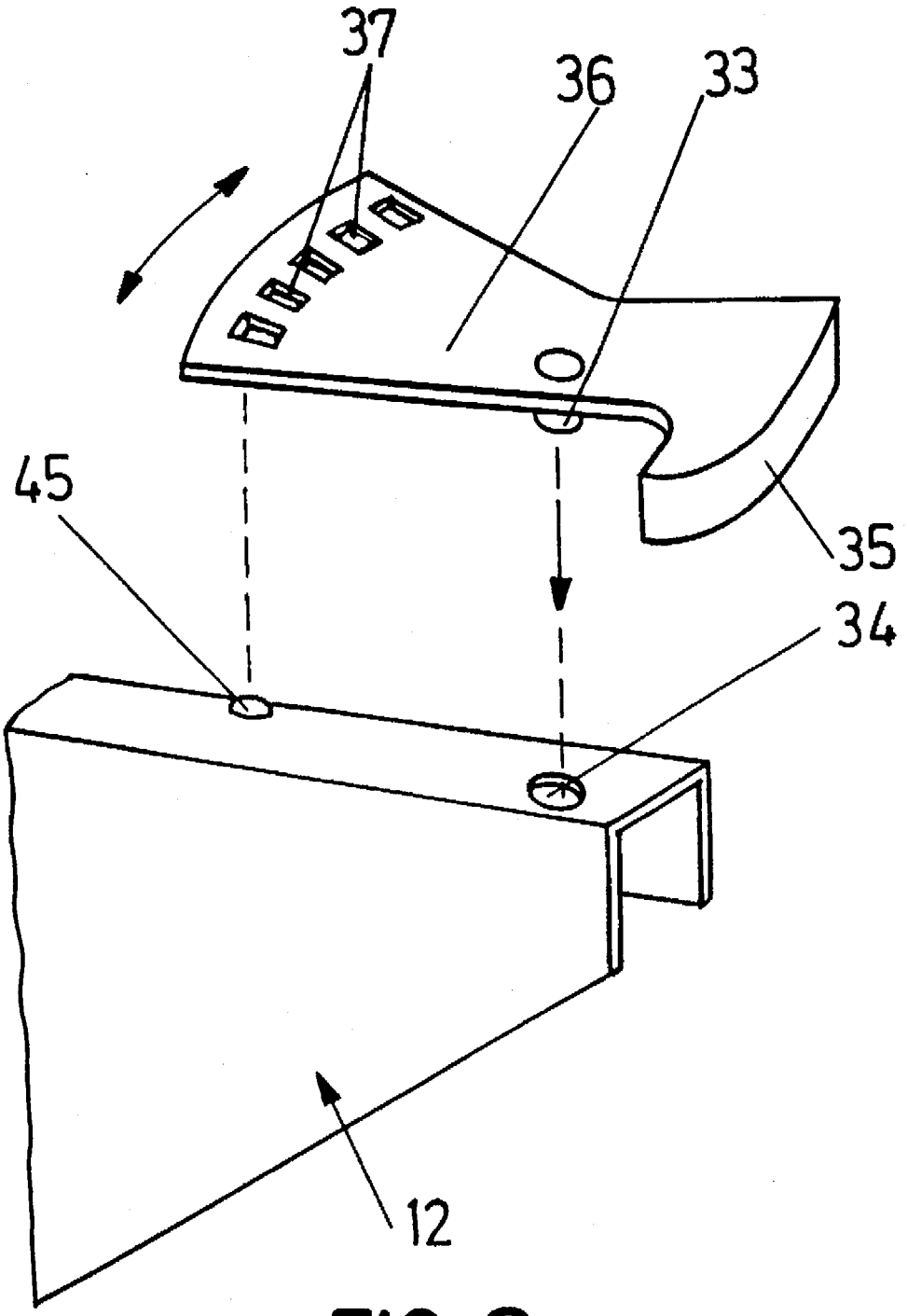

In the embodiment according to FIG. 8 the strut comprises a member 32 mounted to pivot relative to rail 12 about a vertical axis defined by projection or pin 33. Member 32 has a first portion to abut the side wall 3 of the cabinet and a second portion, opposite from the first portion relative to the axis of pin 33, having means to enable member 32 to be fixed relative to support rail 12. Member 32 has segmental configuration. The pin 33 protrudes from member 32 into a hole 34 of the support rail 12. The first portion of member 32 is provided with an outer curved web 35 which abuts the furniture side wall 3 and increases the stability of the member 32. The means enabling member 32 to be fixed relative to rail 12 comprise an arc-shaped arrangement of holes 37 formed in the second portion, and a projection 45 on support rail 12 and positioned to extend into a selected said hole 37 (see FIG. 9). The holes 37 of the member 32 and the projection 45 on the horizontal flange of the support rail 12 prevent an unintended rotation of the member 32 when the support rail 12 is pressed to the side wall 3.

Figure 10:
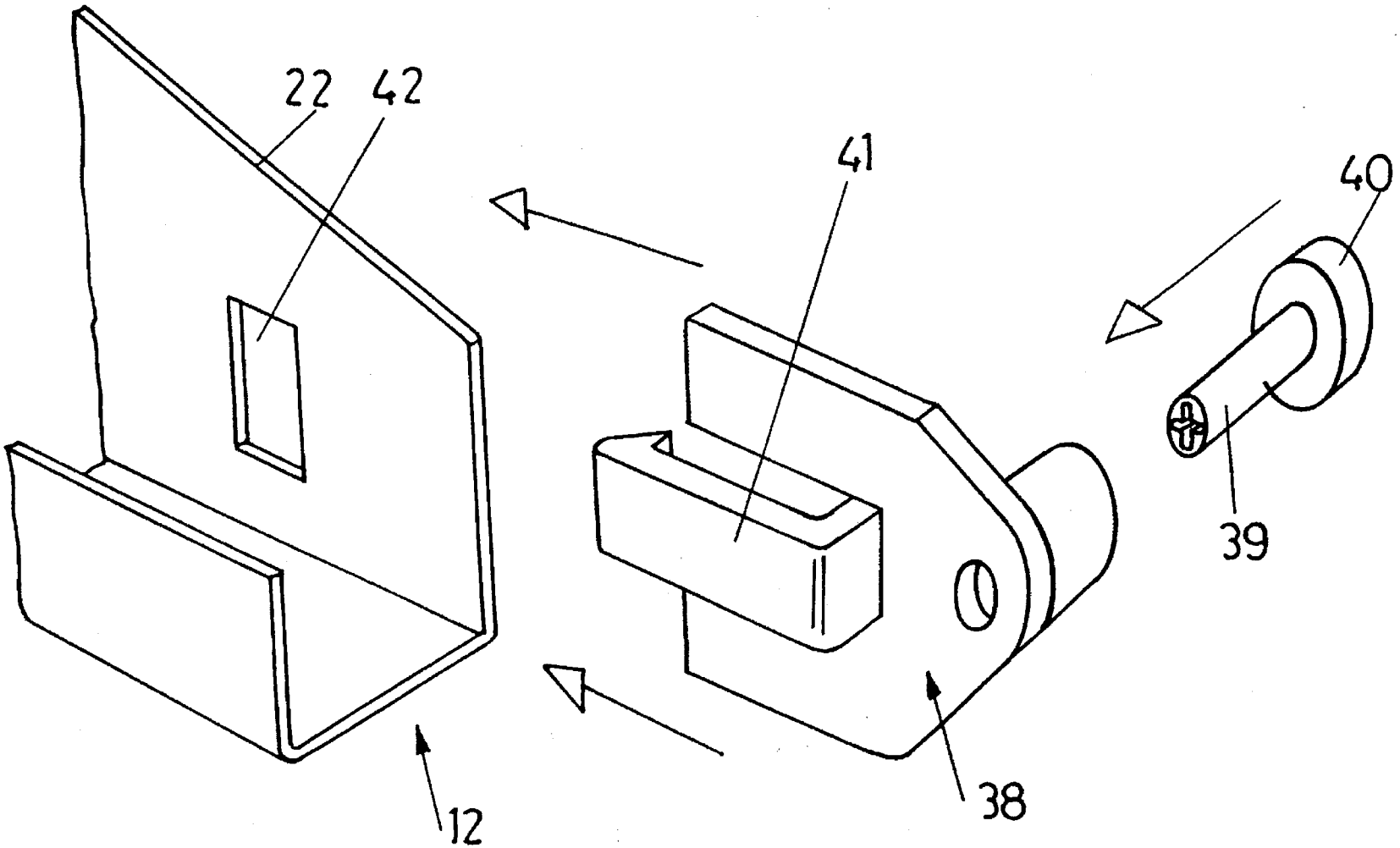

In the embodiment of FIG. 10 the strut comprises a carrier member 38 holding a threaded member 39 which has an end 40 which abuts the cabinet side wall 3. The threaded member 39 can be turned by means of a screw driver or the like to extend more or less from the carrier member 38. The carrier member 38 is provided with a hook portion 41 by means of which it can be fastened on the flange 22 of the support rail 12. The hook portion 41 extends into a slot 42 in the flange 22. Advantageously, the threaded member 39 extends from the carrier member 38 so far that it abuts the furniture side wall 3.

Figure 11:
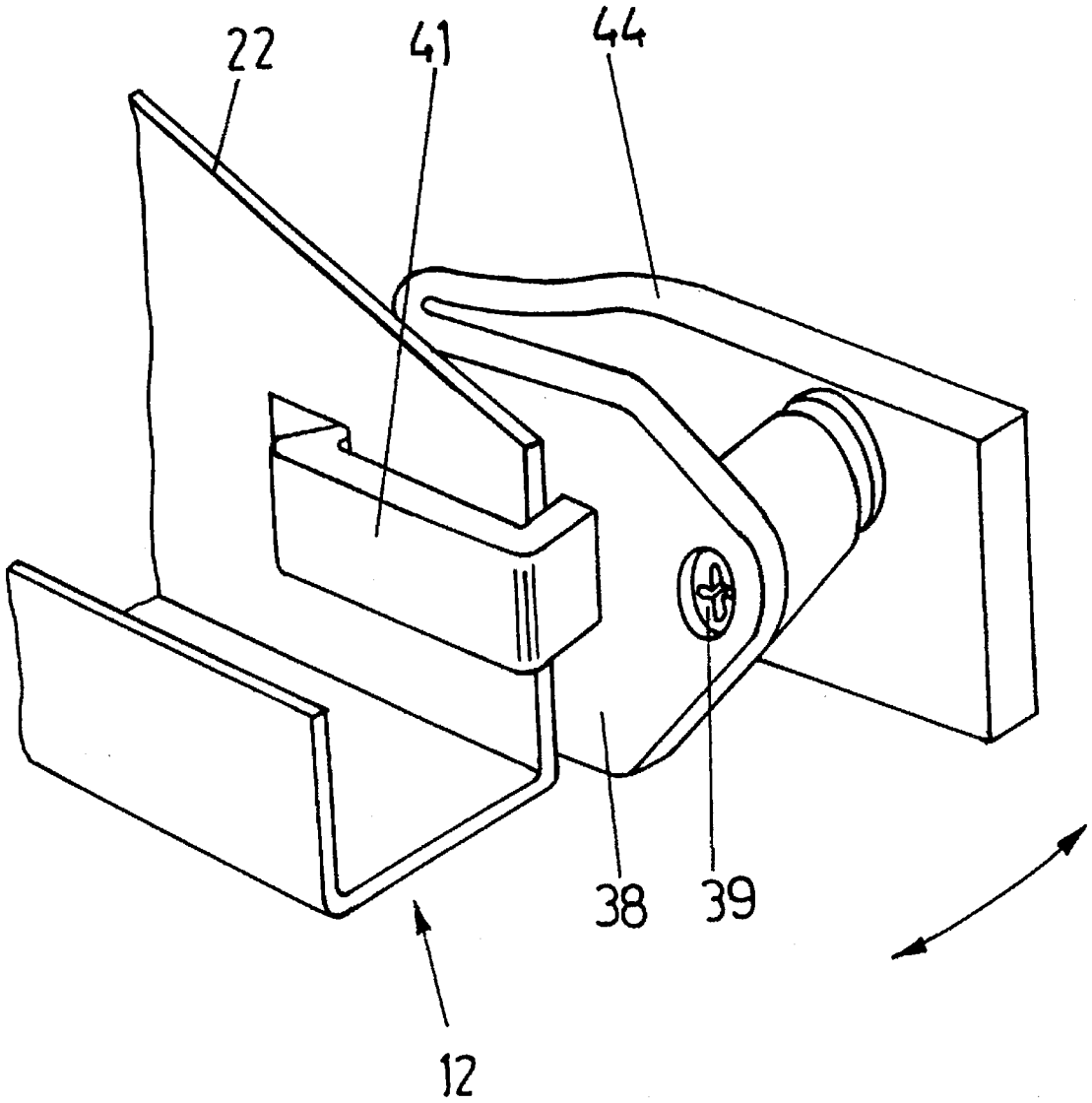

In the embodiment of FIG. 11 the carrier member 38 is provided with a flexible bent extension 44. The carrier member 38 is also provided with a hook portion 41 by means of which it is fixed to the support rail 12. The threaded member 39 which is held in the carrier member 38 abuts the flexible bent extension 44. By turning the threaded member 39 the flexible bent extension 44 can be pressed to the furniture side wall 3.

In all the embodiments described above it is possible to provide the face of the strut that contacts the furniture side wall 3 with an adhesive layer. The adhesive layer may be an adhesive tape.

The support rail 12 is provided at its front end with a stop 29. The pull-out rail 14 is provided with a lever 17 acted upon by a spring. When normally using the drawer, the lever 17 is pressed outwardly by the spring and therefore strikes the stop 29 when the drawer reaches its foremost position. This prevents the drawer from being unintentionally drawn totally out of the cabinet. In case the drawer should be i.e. moved from the cabinet, the lever 17 is turned towards the drawer side wall 3. In this position lever 17 can pass the stop 29 so that the drawer can be pulled out of the cabinet. The lever 17 is held in a bracket which prevents the front end of the lever 17 from brushing against the vertical flange 22 of the support rail 12 during normal use of the drawer.

We claim:

1. A support rail to be mounted on a side of a cabinet of an article of furniture and to cooperate with a pull-out rail mounted on a side of a drawer to form a guide assembly to guide movement of the drawer into and out of the cabinet, said support rail comprising:

an elongated member having a generally U-shaped transverse cross-sectional configuration defined by inner and outer laterally spaced vertical flanges joined by a horizontal flange;

a front end having means to enable said outer vertical flange to be fastened to a vertical portion of the frame of the cabinet;

a rear end extending longitudinally from said front end and to extend rearwardly into the cabinet without connection thereto; and a strut on said rear end and projecting laterally beyond said outer vertical flange in a direction relative thereto opposite said horizontal flange, thereby to abut a side wall of the cabinet and to provide lateral bracing of said support rail.

2. A support rail as claimed in claim 1, wherein said horizontal flange joins bottoms of said inner and outer vertical flanges.

3. A support rail as claimed in claim 1, wherein said strut comprises a block member mounted on said outer vertical flange at said rear end of said support rail.

4. A support rail as claimed in claim 3, wherein said block member has a slot within which fits said outer vertical flange.

5. A support rail as claimed in claim 3, wherein said block member fits within a recess formed in said outer vertical flange.

6. A support rail as claimed in claim 3, wherein said block member is formed of plastic material.

7. A support rail as claimed in claim 1, wherein said strut comprises an eccentric disc.

8. A support rail as claimed in claim 7, wherein said disc is rotatable about a vertical axis.

9. A support rail as claimed in claim 8, wherein said disc has a polygonal shape defined by plural edges spaced from said axis by different distances.

10. A support rail as claimed in claim 8, wherein said axis is mounted in a horizontal member extending from said rail.

11. A support rail as claimed in claim 1, wherein said strut comprises a member mounted to pivot relative to said rail about a vertical axis, said member having a first portion to abut the side wall of the cabinet and a second portion, opposite from said first portion relative to said axis, having means to enable said member to be fixed relative to said rail.

12. A support rail as claimed in claim 11, wherein said first portion comprises an outer curved web.

13. A support rail as claimed in claim 11, wherein said means comprise an arc-shaped arrangement of holes formed in said second portion, and a projection on said rail is positioned to extend into a selected said hole.

14. A support rail as claimed in claim 11, wherein said member has a segmental configuration.

15. A support rail as claimed in claim 1, wherein said strut comprises a carrier member fastened to said rail by a hook portion and wherein said outer vertical flange has therein a recess, said hook portion is spaced from said carrier member, said flange fits between said hook portion and said carrier member, and said hook portion includes an end hook fitting into said recess.

16. A support rail as claimed in claim 15, further comprising an abutment member connected to said carrier member.

17. A support rail as claimed in claim 11, wherein said abutment member is threaded to said carrier member and has an end to abut the side wall of the cabinet.

18. A support rail as claimed in claim 16, wherein said carrier member has extending therefrom a flexible bent extension to abut the side wall of the cabinet, and said abutment member is threaded to said carrier member and abuts said extension.

19. A support rail as claimed in claim 1, wherein said strut projects in said direction beyond a greatest dimension of said outer vertical flange throughout the length of said rail.

* * * * *